US011697566B2

(12) United States Patent
Hirakawa

(10) Patent No.: US 11,697,566 B2
(45) Date of Patent: Jul. 11, 2023

(54) FLAGGING TAPE DISPENSING SYSTEM

(71) Applicant: Wayne Grimes Hirakawa, Waianae, HI (US)

(72) Inventor: Wayne Grimes Hirakawa, Waianae, HI (US)

( * ) Notice: Subject to any disclaimer, the term of this patent is extended or adjusted under 35 U.S.C. 154(b) by 47 days.

(21) Appl. No.: 17/315,241

(22) Filed: May 7, 2021

(65) Prior Publication Data

US 2021/0347592 A1 Nov. 11, 2021

Related U.S. Application Data

(60) Provisional application No. 63/021,356, filed on May 7, 2020.

(51) Int. Cl.
*B65H 16/00* (2006.01)

(52) U.S. Cl.
CPC ..... *B65H 16/005* (2013.01)

(58) Field of Classification Search
CPC ..... B65H 75/241; B65H 75/2413; B65H 2701/534
See application file for complete search history.

(56) References Cited

U.S. PATENT DOCUMENTS

| | | | | |
|---|---|---|---|---|
| 1,029,490 A | | 6/1912 | Connors et al. | |
| 1,268,222 A | | 6/1918 | Dwyer | |
| 2,790,609 A | | 4/1957 | Hawthorne | |
| 2,929,540 A | | 3/1960 | Carey | |
| 3,502,252 A | | 3/1970 | Mariani | |
| 3,719,272 A | * | 3/1973 | Bodine | B65H 75/22 220/4.27 |
| 3,902,679 A | * | 9/1975 | Bost | B65H 49/16 242/129 |
| 4,252,258 A | | 2/1981 | Plummer, III | |
| 4,262,835 A | | 4/1981 | Wrobel | |
| 4,447,015 A | * | 5/1984 | Peterson | A47K 10/40 242/612 |
| 4,527,722 A | | 7/1985 | Strachan | |
| 4,735,351 A | * | 4/1988 | Biswas | B65H 35/0026 225/25 |
| 4,884,734 A | | 12/1989 | Kahl, Jr. et al. | |
| 4,979,414 A | | 12/1990 | Caveney et al. | |
| 5,494,204 A | | 2/1996 | Wang | |
| 5,538,170 A | | 7/1996 | Van Luit | |
| 5,957,358 A | | 9/1999 | Getz et al. | |

(Continued)

FOREIGN PATENT DOCUMENTS

| | | | |
|---|---|---|---|
| EP | 0135695 A1 | | 4/1985 |
| FR | 2 357 766 | * | 3/1978 |
| GB | 2 162 493 | * | 2/1986 |

*Primary Examiner* — William A. Rivera
(74) *Attorney, Agent, or Firm* — Jason P. Webb; Pearson Butler

(57) ABSTRACT

A tape dispensing system, including: a first roll cartridge including a hub with a first axial side and a second axial side opposite the first side; a first twist-lock connector integral with the first axial side of the hub a second twist-lock connector integral with the second axial side of the hub; a tape cutter extending radially from the hub; and a second roll cartridge substantially identical to the first roll cartridge, the first twist-lock connector of the second roll cartridge mates with the second twist lock connector of the first roll cartridge.

18 Claims, 8 Drawing Sheets

(56) References Cited

U.S. PATENT DOCUMENTS

| | | | | |
|---|---|---|---|---|
| 6,729,512 | B1 * | 5/2004 | Leighton | B65H 35/002 242/598.5 |
| 8,499,965 | B2 | 8/2013 | Sheffield | |
| 2003/0098384 | A1 | 5/2003 | Black | |
| 2008/0217351 | A1 * | 9/2008 | Unda | B65H 35/0026 221/34 |
| 2012/0006932 | A1 * | 1/2012 | Chang | B65H 35/0026 242/598 |
| 2013/0341354 | A1 * | 12/2013 | Archer | A47K 5/1201 222/105 |
| 2016/0152434 | A1 * | 6/2016 | Diangelo | B65H 35/0026 225/34 |
| 2022/0177259 | A1 * | 6/2022 | Roa-Quispe | B65H 75/2272 |

* cited by examiner

FLAGGING TAPE DISPENSING SYSTEM

CROSS-REFERENCE TO RELATED APPLICATIONS

This invention claims priority, under 35 U.S.C. § 120, to the U.S. Provisional Patent Application No. 63/021,356 to Wayne Grimes Hirakawa filed on May 7, 2020, which is incorporated by reference herein.

BACKGROUND OF THE INVENTION

Field of the Invention

The present invention relates to tape/ribbon dispensing systems, specifically flagging tape dispensing systems that allow for multiple tapes/ribbons.

Description of the Related Art

Professional construction projects use various tools to improve quality and safety, especially where multiple different entities or professional groups are involved. One such tool is mark/tag various locations, elements, aspects, equipment, and the like so that there is clarity at the site and consistency in how such are treated. Often strips of tape of various colors are used in such marking. Therefore, it becomes necessary to have someone go to a site with rolls of varying colored tape to properly mark the site. The colors that are used and the situations in which they are used will change from site to site and application to application.

In the related art, it has been known to use modular dispensing systems to hold and dispense multiple pieces of tape as well as connect to form a single larger unit. These dispensing systems are sometimes difficult to use and carry around and/or sometimes fail to securely attach to one another. Some improvements have been made in the field. Examples of references related to the present invention are described below in their own words, and the supporting teachings of each reference are incorporated by reference herein:

U.S. Pat. No. 3,502,252, issued to Mariani, discloses a dispenser that is composed of a plurality of discrete modules which can be positioned with respect to one another by hermaphroditic coupling means and joined by a fastening means. Each module comprises one outer wall, a web hub, a tape guide and two cutting edges. The fastening means is removable so that individual modules may be removed or replaced. Alternate use of particular cutting edges permits close spacing of the modules.

U.S. Pat. No. 4,527,722, issued to Strachan, discloses a multiple unit tape dispenser having a plurality of juxtaposed, generally hollow plastic housings, each of which contains a roll of tape. Each housing has a front dispenser wall which has a slot across the width of the housing which is dimensioned to permit withdrawal of tape longitudinally from the roll of tape within the housing. A tape support shelf extending outwardly from the front dispenser wall of each housing is situated adjacent the slot and is positioned to underly a length of tape when withdrawn from the housing. To aid removal of the tape, the under side of the shelf is provided with a series of spaced, lateral ribs. A spindle is situated within each housing for mounting of the roll of tape. Adjacent housings are attached to one another via a pin-and-aperture arrangement and an extension of each spindle which engages a socket in an adjacent housing. An end plate is shaped to cover the otherwise open side of a housing of the dispenser.

U.S. Pat. No. 5,957,358, issued to Getz et al., discloses a battery strip dispenser for dispensing user-selectable combinations of batteries to consumers. The battery strip dispenser includes a dispensing mechanism for holding batteries, and further includes a battery strip containing a plurality of batteries packaged in flexible packaging material. The battery strip includes a plurality of packages, each containing a battery, and has perforations formed in the packaging material between adjacent packaged batteries. The battery strip can be dispensed from the dispensing mechanism, and packaged batteries can be separated from other batteries in the battery strip by tearing at the perforations to separate a desired number of batteries.

U.S. Pat. No. 8,499,965, issued to Sheffield, discloses a dispenser for an orally dissolvable strip includes a pair of receiving spools for receiving respective layers of wrap material that sandwich the orally dissolvable strip. A rotatable knob is coupled to the spools for actuating the spools. A force transfer apparatus is configured to rotate the second spool when the first spool rotates. A housing contains the receiving spools, force transfer apparatus, orally dissolvable strip, and layers of wrap material, the housing having a slot sized for the dissolvable strip to pass through. A coupling element is connected to a housing side wall configured connect the housing laterally to another housing side wall. A channel extends between a knob input aperture and a housing rear plate output channel. A drive shaft is positioned in the channel and configured to extend from the output channel and operatively couple the rotatable knob with a rotatable knob of another dispenser.

The inventions heretofore known suffer from a number of disadvantages, including but not limited to: being inflexible in use, not being versatile, taking too long to make a ribbon change, being difficult to use, not being accessible, being difficult to change out color sets, being difficult to change the color order of ribbons, creating messes, being difficult for new operators/technicians to use/learn, and/or making it difficult to train new operators/technicians.

What is needed is a ribbon/tape dispensing system that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available docking and mooring devices. Accordingly, the present invention has been developed to provide a satisfactory tape/ribbon dispensing system.

There may be a tape dispensing system, which may include one or more of the following: a first roll cartridge, the first roll cartridge may include one or more of a hub, which may have a first axial side and/or a second axial side which may be opposite the first side, a first twist-lock connector, which may be integral with the first axial side of the hub, a second twist-lock connector, which may be integral with the second axial side of the hub, and a tape cutter, which may extend radially from the hub, a second roll cartridge, which may be substantially identical to the first roll cartridge, the first twist-lock connector of the second roll cartridge may mate with the second twist lock connector of the first roll cartridge, the tape cutter may include a threading slot, the tape cutter may include a locking pin and/or a locking pin receptacle, the locking pin receptacle may be opposite the locking pin, a star-shaped base plate which may extend radially away from the hub, the first twist-lock connector may be an array of male protrusions, the second twist-lock connector may be an array of female receptacles which may be shaped to receive the male protrusions, a plurality of roll-centering ridges which may extend radially from the hub, a third roll cartridge, the third roll cartridge may include a twist-lock connector which may be opposite a carabiner mount, the third roll cartridge may include a star-shaped baseplate which may extend radially from the twist-lock connector, the star-shaped base plate of the third roll cartridge may include a locking pin receptacle, a slot, which may be within the first roll cartridge and/or the second roll cartridge and may hold a writing instrument, a carabiner mount and/or carabiner which may be connected to the first roll cartridge and or second roll cartridge.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
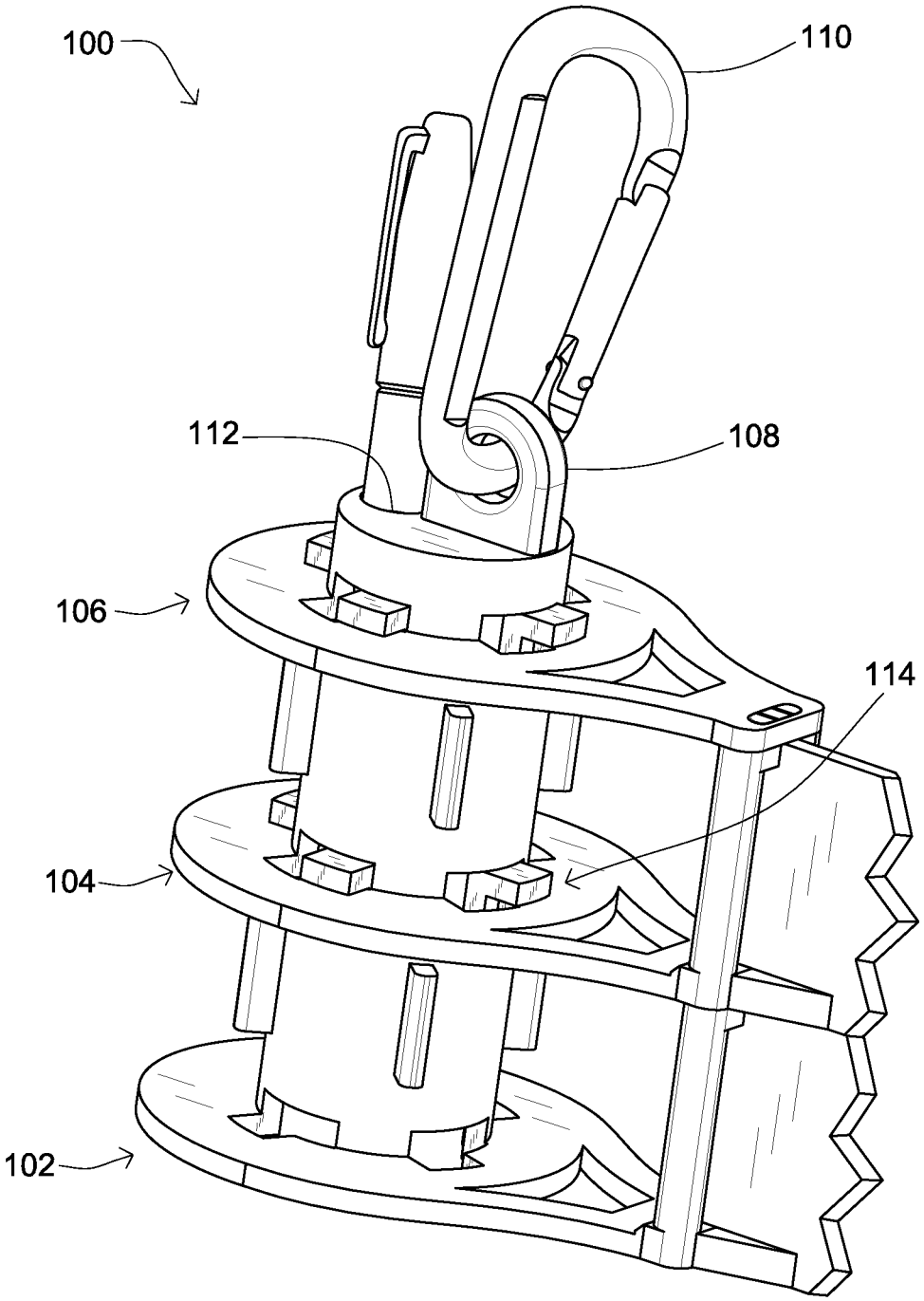
FIG. 1 is a top perspective view of a flagging tape dispensing system, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims or may be learned by the practice of the invention as set forth hereinafter.

FIG. 1 is a top perspective view of a flagging tape dispensing system, according to one embodiment of the invention. The illustrated flagging tape dispensing system 100 is complete, as shown, and ready to use. A complete flagging tape dispensing system 100 includes at least a first roll cartridge 102 and a second roll cartridge 104 rigidly coupled to one another. The second roll cartridge 104 is substantially identical to the first roll cartridge 102, however in other embodiments, the second roll cartridge 104 may be dissimilar to the first roll cartridge 102 as long as the second roll cartridge 104 may still be rigidly coupled to the first roll cartridge 102.

The illustrated flagging tape dispensing system 100 includes three roll cartridges, the first roll cartridge 102 and the second roll cartridge 104 being substantially identical, and a third roll cartridge 106 which is different than the first two and acts as an end cap so the flagging tape dispensing system 100 may be easily carried by a user. In other embodiments, however, a complete flagging tape dispensing system 100 may include a plurality of roll cartridges, each of the plurality of roll cartridges rigidly coupled to one another in series forming a stack.

The illustrated flagging tape dispensing system 100 also includes a carabiner mount 108 connected to the third roll cartridge 106, to which a carabiner 110 is attached. The carabiner mount 108 is a rounded tab with a through hole in the middle to accommodate one or more sizes of carabiners 110 and/or other like mounting devices, however, the mount and/or the through hole in the mount may be any number of geometrical shapes and sizes, including but not limited to: circular, rectangular, triangular, polygonal irregular, and the like and combinations thereof. In other embodiments, the carabiner mount 108 of the flagging tape dispensing system 100 may be configured to receive other fastening mechanisms such as pins, rivets, ball detents, screws, set screws, and the like and combinations thereof.

The illustrated flagging tape dispensing system 100 also includes a slot 112 in the third roll cartridge 106 which fits a writing utensil. The slot 112 may be any number of shapes and sizes to loosely or securely fit one or more writing utensils, and there may be a plurality of slots 112.

The structural pieces of the flagging tape dispensing system 100 may be made of any material with a high strength-to-weight ratio, such as metals, hard and/or soft plastics, woods, and the like and combinations thereof. These materials may be plated, coated, molded, impregnated, and/or painted with various materials, oils, or chemicals to assist in preventing various types of exposure damage including but not limited to corrosion, ultraviolet light, impact, or abrasive damage.

Further, the flagging tape dispensing system 100 may be partially or fully made of buoyant materials, including but not limited to foams, woods, plastics, and the like and combinations thereof. The materials may be formed, molded, or otherwise created to provide buoyancy, a non-limiting example of which is the materials created with hollow sections.

The roll cartridges are connected to each other at a cartridge mate 114. The illustrated cartridge mate 114 connects the bottom of one cartridge to the top of another cartridge via a twist-lock structure. However, other embodiments may instead have one or more of the cartridge mates 114 created via threading together, adhesives, epoxies, press fitting, latching, and the like and combinations thereof.

In operation, a user is able to use the flagging tape dispensing system 100 to dispense one or more rolls of flagging tape by pressing together the top of the first roll cartridge 102 with the bottom of the second roll cartridge 104 at the cartridge mate 114 and then twisting the first roll cartridge 102 and second roll cartridge 104 relative to one another to securely mate them together. If the user has used a roll cartridge with a carabiner mount 108 and/or a writing utensil slot 112, the user may then hook the flagging tape dispensing system 100 to their belt via clipping the carabiner 110 to their belt or other attachment point.

If the user desires additional rolls of flagging tape at their disposal, the user may simply further mate roll cartridges onto the bottom of the bottommost roll cartridge or may disconnect roll cartridges at the roll cartridge mate 114 to create any series combination of roll cartridges to form a stack. When the user is satisfied with both the number and arrangement of roll cartridges, the user may then clip the entire stack to their belt.

When finished using the modular flagging tape dispensing system 100, the user may simply twist two cartridges at their respective cartridge mates 114 and pull the cartridges away from one another to release them. The user may repeat this step until all mated cartridges are no longer mated.

Advantageously, the modular roll cartridges allow the user to quickly hot swap out roll cartridges with their associated rolls of tape on the fly, and even add or subtract roll cartridges from the flagging tape dispensing system 100 if they find out they need additional or fewer rolls of tape for the current project. This even allows the user to pre-stack sets of roll cartridges by color or project need and swap out a whole set of cartridges at once which allows the user to save a lot of time as the user simply can swap which set is connected to a combiner or other connector and immediately head out to the job without needing to fumble with disassembling and then reassembling an entirely new stack of flagging tape.

Accordingly, this allows the user to be versatile in the number of rolls they can carry at any given time as well as allows the user to have multiple rolls of different colors of flagging tape at any given time. It also allows for very quick, easy, and lightweight operation with just a single roll when the user does not need to carry multiple rolls or when the user does not have the space to carry multiple.

Figure 2:
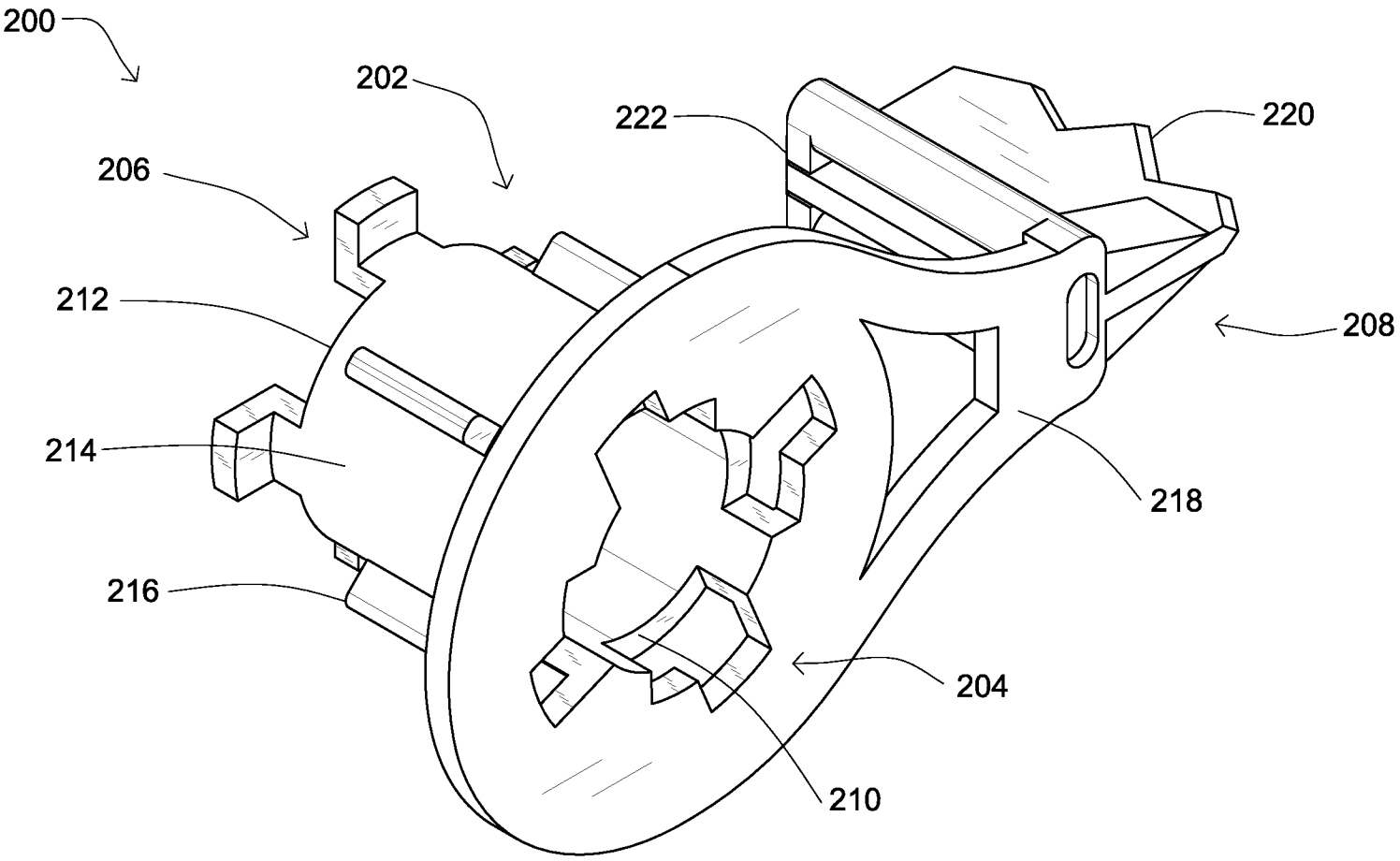
FIG. 2 is a bottom perspective view of roll cartridge, according to one embodiment of the invention.

FIG. 2 is a bottom perspective view of roll cartridge, according to one embodiment of the invention. There is shown a roll cartridge 200 including a hub 202, a first twist-lock connector 204, a second twist-lock connector 206, and a tape cutter 208.

The illustrated hub 202 includes an first axial side 210 and a second axial side 212, the second axial side 212 directly opposite the first axial side 210. In other embodiments, the first axial side 210 and the second axial side 212 of the hub 202 may only be substantially opposite one another. The illustrated hub 202 also includes a roll centering cylinder 214 between the first axial side 210 and the second axial side 212. The roll centering cylinder 214 may support and/or trap the flagging tape so that is stays engaged with the hub 202.

Protruding outwardly from the illustrated roll centering cylinder 214 are a plurality of roll centering ridges 216, which further center coupled tape rolls and provide rotational freedom to facilitate the roll spinning during use. In some embodiments, the roll centering cylinder 214 or roll centering ridges 216 may be spring loaded or otherwise compressible or foldable in order to facilitate different inner diameter sizes of flagging tape rolls and/or to apply frictional resistance to roll spinning to prevent unwanted tape dispensing.

The first axial side 210 may also include a baseplate 218 extending therefrom, the baseplate 218 may provide structure and ease of handling, assembly, and disassembly to the roll cartridge 200. The base plate also provides and strengthens the connection between the hub 202 and the tape cutter 208.

The illustrated first twist-lock connector 204 is integral with the first axial side 210 of the hub 202, however in other embodiments may be a separate section connected to the first axial side 210 of the hub 202. The illustrated first twist-lock connector 204 is a female mating connector and may be a set of apertures extending through the roll centering cylinder 214 and/or baseplate 218 of the hub 202. The set of apertures are shaped and positioned to accept the illustrated second twist-lock connector 206 and soft lock therewith, such that the mating structures may be fitted together but may also be easily disengaged.

The illustrated second twist-lock connector 206 is integral with the second axial side 212 of the hub 202, however in other embodiments may be a separate section connected to the second axial side 212 of the hub 202. The illustrated second twist-lock connector 206 is a male mating connector and may include a plurality of protrusions from the illustrated roll centering cylinder 214. The protrusions may be shaped to fit into the recess/slot formed by the first twist-lock connector 204.

The illustrated protrusions are L-shaped brackets that face outward. However, in other various embodiments, such protrusions may have a different shape and/or may protrude with a different orientation, e.g. inwards, outwards, or a combination. The design of the second twist-lock connector 206 is not restricted to L-shaped brackets and may be any shape and/or angle that allows the second twist-lock connector 206 to solidly engage the first twist-lock connector 204.

The mating of the roll cartridges 200 may be accomplished by simple friction fitting of the first twist-lock connector 204 and second twist-lock connector 206 and/or by snap-lock structures therein that offer a more secure coupling with a sound/feel that lets the user know that the coupling is complete. The roll centering cylinder 214 may include a backstop for the second twist-lock connector 206 when it is inserted into the first twist-lock connector 204 so that the second twist-lock connector 206 lines up properly with the slot of the first twist-lock connector 204.

These paired twist-lock connectors, 204 and 206, allow the roll cartridges 200 to stack neatly and easily when combined in series. While the illustrated twist-lock connectors, 204 and 206, are directly in line with each other, it is understood that various embodiments may have a different configuration, which may result in a stack that is shaped differently from the illustrated stack of FIG. 1, such as but not limited to a curving stack, wherein twist-lock connectors, 204 and 206, may be offset and/or not directly opposing (i.e. angled in relation to each other).

Although described in the embodiment shown, the first twist-lock connector 204 and second twist-lock connector 206 need not be only twist lock connectors. They may also/alternatively be other types of connectors such as a latch connectors, snap connectors, quick-lock connectors, and the like, and/or any other quick engaging and disengaging connectors.

The illustrated tape cutter 208 is rigidly attached to the hub 202 and includes a number of teeth 220 and a threading slot 222. The tape cutter 208 may be used to cut flagging tape once a desired length is reached, by pulling the flagging tape against the teeth 220.

The illustrated teeth 220 create a serrated edge, however, a straight and/or curved edge instead of the illustrated serrated edge may be used so long as it properly cuts the associated tape. It is contemplated that there may be removable tape cutters 208 or teeth 220 so the user can adjust the tape cutter 208 to best suit the material to be cut. Other embodiments may include an adhesive layer on the tape cutter 208 and/or teeth 220, or the tape cutter 208 and/or teeth 220 may be friction enhanced by the surface structure, texture, or material used.

The illustrated threading slot 222 is a thin cutout in the tape cutter 208 where flagging tape may be threaded through and lined up with the teeth 220 so that the flagging tape is directly along the teeth 220 when pulled by the user. The illustrated tape cutter 208 contains two threading slots 222, one on each side of the teeth 220 which allows the user to place the flagging tape on either side of the integrated tearing edge so the user can cut the flagging tape in the user's preferred direction. In other embodiments, there may only be one threading slot 222 which may be on one side.

In other embodiments, the tape cutter 208 may include a tensioner so that the tape end is held more firmly in place when not in use. The tensioner may be connected to the roll cartridge 200 and may contain multiple flexible pieces. The tensioner may be a friction-biased slot through which the flagging tape is threaded. Such a tensioner may consist of two thin opposing u-shaped plates that are biased to create a clamping effect against each other where they flex together. Such a U-shape may allow the user to engage their fingers with the plates and pull them apart from each other to more easily thread a strip of flagging tape therethrough once the roll of tape is mounted on the roll cartridge 200.

A tensioner may be configured to be large enough or flexible enough to allow a strip of flagging tape to be started and be more easily placed between the tensioner so that the user does not have to attempt to push the flagging tape through the tensioner from the roll side. A tensioner may allow the user to pull thin strips of flagging tape through the tensioner system, yet when the user cuts a piece of flagging tape using the integrated tearing edge, the tensioner keeps the remaining flagging tape in place so the roll of flagging tape does not unravel or tangle. Other embodiments may have tensioners with teeth, a single clamp, spring loaded, friction enhanced surface or material, have a different shape, or other ways to hold the flagging tape in place.

Additionally, it may be desired to include a measuring dispensing mechanism the hub 202 or tape cutter 208 that measures or otherwise meters out the amount of flagging tape used as it is pulled so the user can easily determine how much is pulled without having to measure it. Furthermore, the metering system may be able to be preset to a specific value or length by the user and have the ability to clamp down on or automatically cut the flagging tape via an electronically controlled ribbon tensioning system or roll cartridge 200 once the value is reached. A non-limiting example of such a metering system is the H-99 Industrial Automatic Tape Dispenser from Uline of Pleasant Prairie, Wis.

The tape cutter 208 may also include a locking pin and a locking pin receptacle opposite the locking pin. The locking pin and locking pin receptacle may assist with lining up multiple tape cutters 208 as well as helping further secure multiple roll cartridges 200 to one another.

Figure 3:
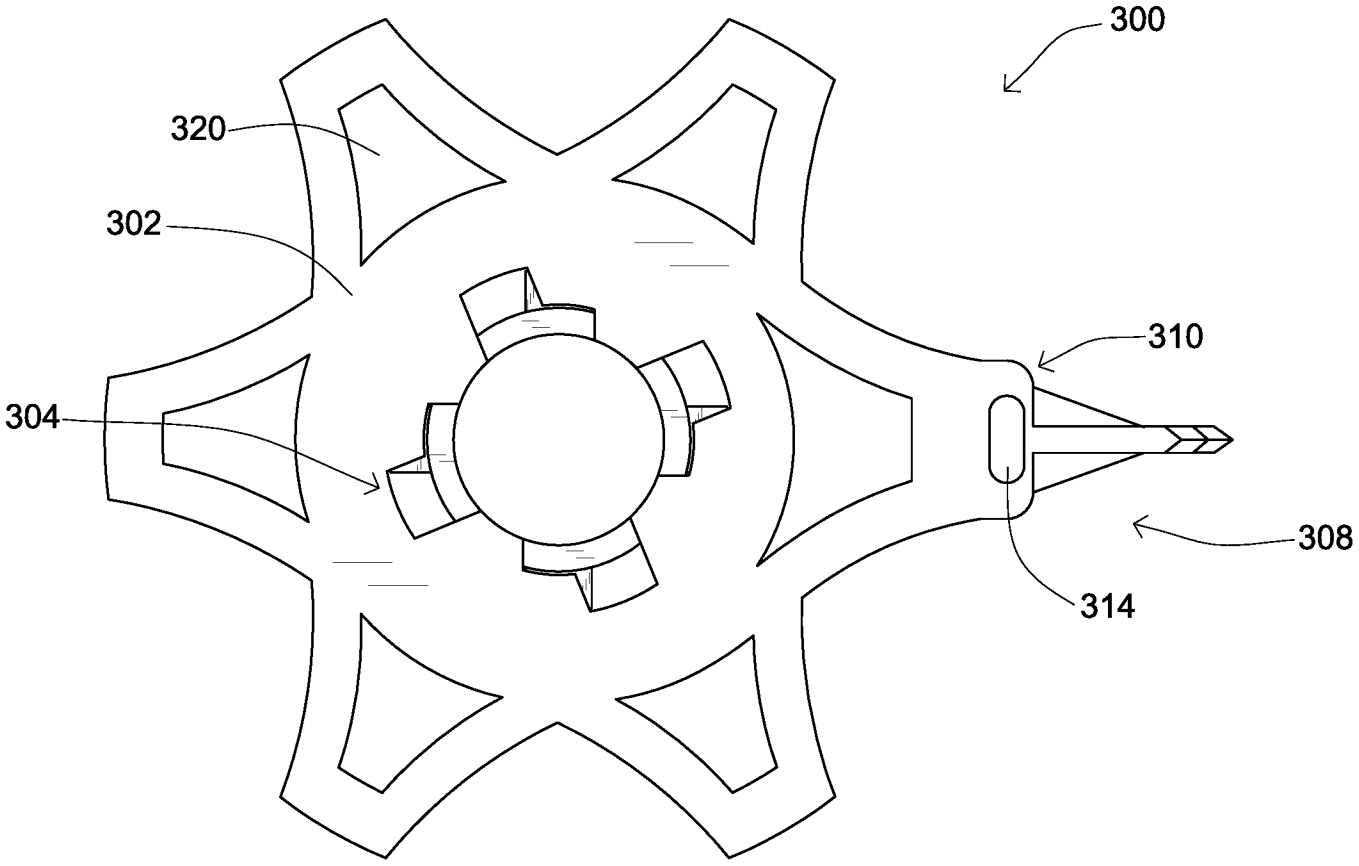
FIG. 3 is a bottom plan view of a roll cartridge, according to one embodiment of the invention.
Figure 4:
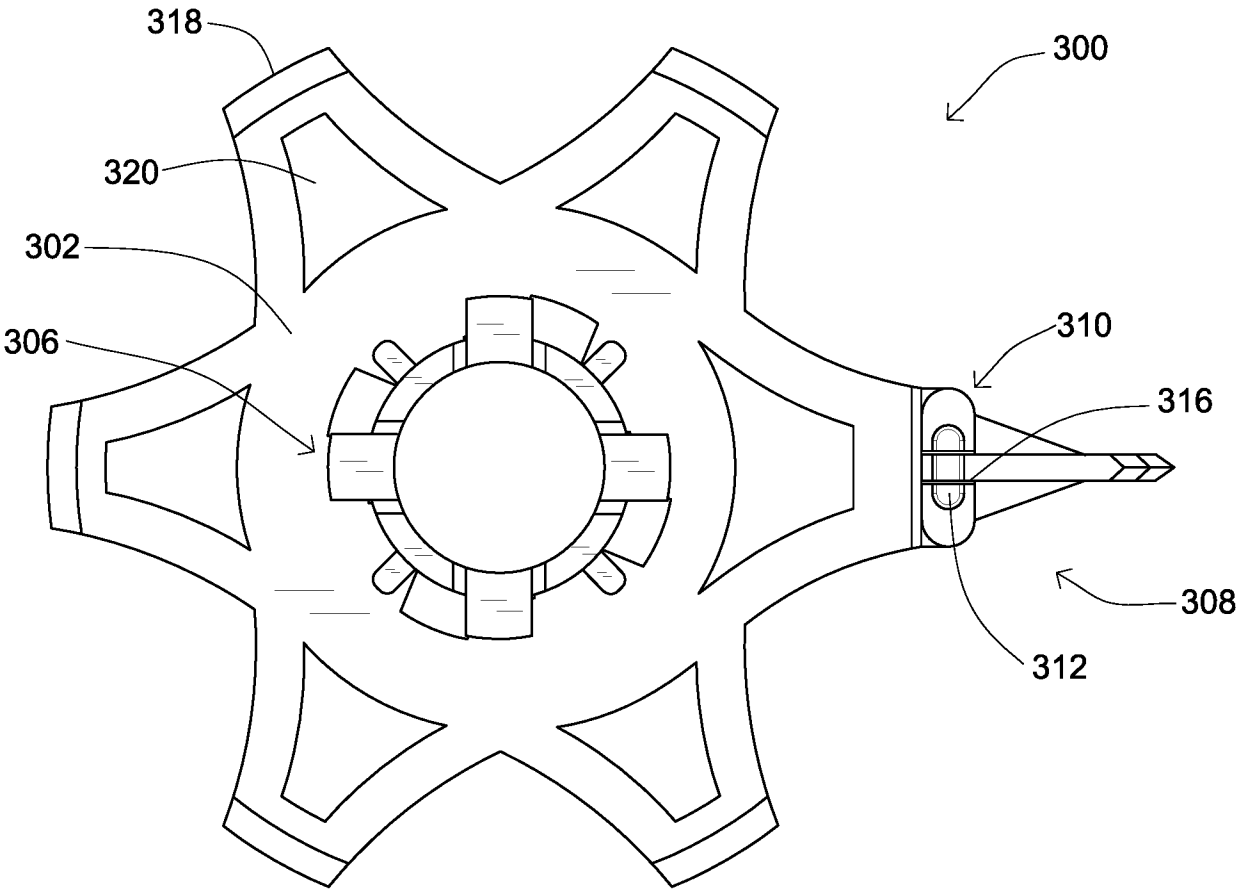
FIG. 4 is a top plan view of a roll cartridge, according to one embodiment of the invention.

FIGS. 3 and 4 are bottom and top plan views, respectively, of a roll cartridge, according to one embodiment of the invention. The illustrated roll cartridge 300 includes a base plate 302, a first twist-lock connector 304, a second twist-lock connector 306, and a tape cutter.

The illustrated base plate 302 is star-shaped to provide additional structure and ease of handling, assembly, and disassembly to the roll cartridge 300. The base plate 302 also provides and strengthens the connection between the hub and the tape cutter 308, so that the roll cartridge 300 does not flex when the user is trying to cut flagging tape. The base plate 302 further includes a lip 318 to help center and keep the tape confined within the roll cartridge 300, as well as protect the tape from damage. The base plate 302 includes a cutout 320 to reduce weight, help the user grip and manipulate the roll cartridge 300, and allow the user some access to the tape while the tape is within the roll cartridge 300.

The illustrated first twist-lock connector 304 and second twist-lock connector 306 are shown with their respective cutouts and protrusions evenly dispersed around the center of the roll cartridge 300 so that the connectors provide even support when mated. However, in other embodiments, the first twist-lock connector 304 and/or second twist-lock connector 306 may not be symmetrical.

The illustrated tape cutter 308 is connected to the base plate 302 and includes a tape cutter mate 310 and threading slot 316. The tape cutter mate 310 provides an additional locking point for the roll cartridge 300 and assists in keeping the base plates 302 from bending or shifting when the roll cartridges 300 are connected. The illustrated threading slot 316 is a small slot cut out of the locking pin 312 of the tape cutter 308, where flagging tape may be inserted through to be pulled out of the roll cartridge 300 and cut on the tape cutter 308.

The tape cutter mate 310 includes a locking pin 312 and a locking pin receptacle 314. The illustrated locking pin 312 locking pin receptable 314 are oblong in shape, the locking pin 312 protruding out from the tape cutter 308, and the locking pin receptacle 314 inset into the tape cutter 308. The locking pin 312 extends through the tape cutter mate 310 and to the locking pin receptacle 314 and is not configured to move within the tape cutter 308. While the locking pin 312 and locking pin receptacle 314 are shown as being attached to the tape cutter 308, either may also or instead be attached to the roll cartridge 300.

The locking pin 312 secures the radial position of adjacent cartridges by fitting into the locking pin receptacle 314 in the adjacent roll cartridge. The illustrated locking pin 312 contains three sections, each separated by a threading slot 316, however, the locking pin 312 may be comprised of one or a plurality of sections.

The locking pin 312 and locking pin receptacle 314 are configured to keep the roll cartridges 300 from rotating relative to each other and thereby disengaging from one another. It is envisioned that some uses may benefit from a more complex design, and other embodiments may have locking pins 312 that do not extend through the tearing edge and/or may be moved or activated by being spring-loaded, lever-activated, or another type of known engagement process, or when pushed or otherwise engaged by the user.

Advantageously, the locking pin 312 configuration allows the locking pin 312 to better secure the tensioner as well as allow the threading slot 316 to feed directly along the tape cutter 308, rather than over or through a locking pin 312, enabling easier threading and cutting of the flagging tape. This also eliminates excess moving parts that may bind, break, or otherwise wear out and makes manufacturing easier and less expensive.

Figure 5:
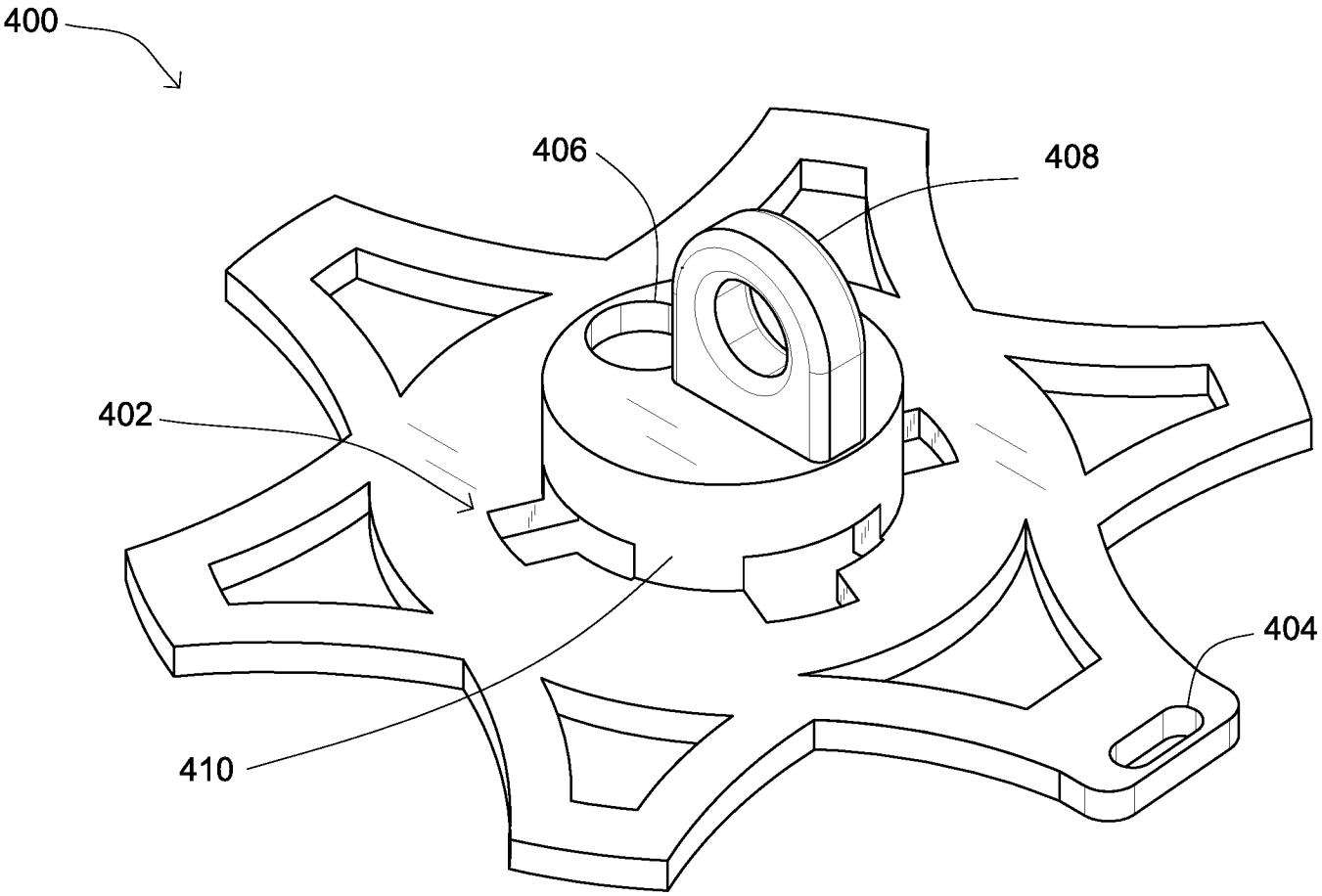
FIG. 5 is a top perspective view of a roll cartridge, according to one embodiment of the invention.
Figure 6:
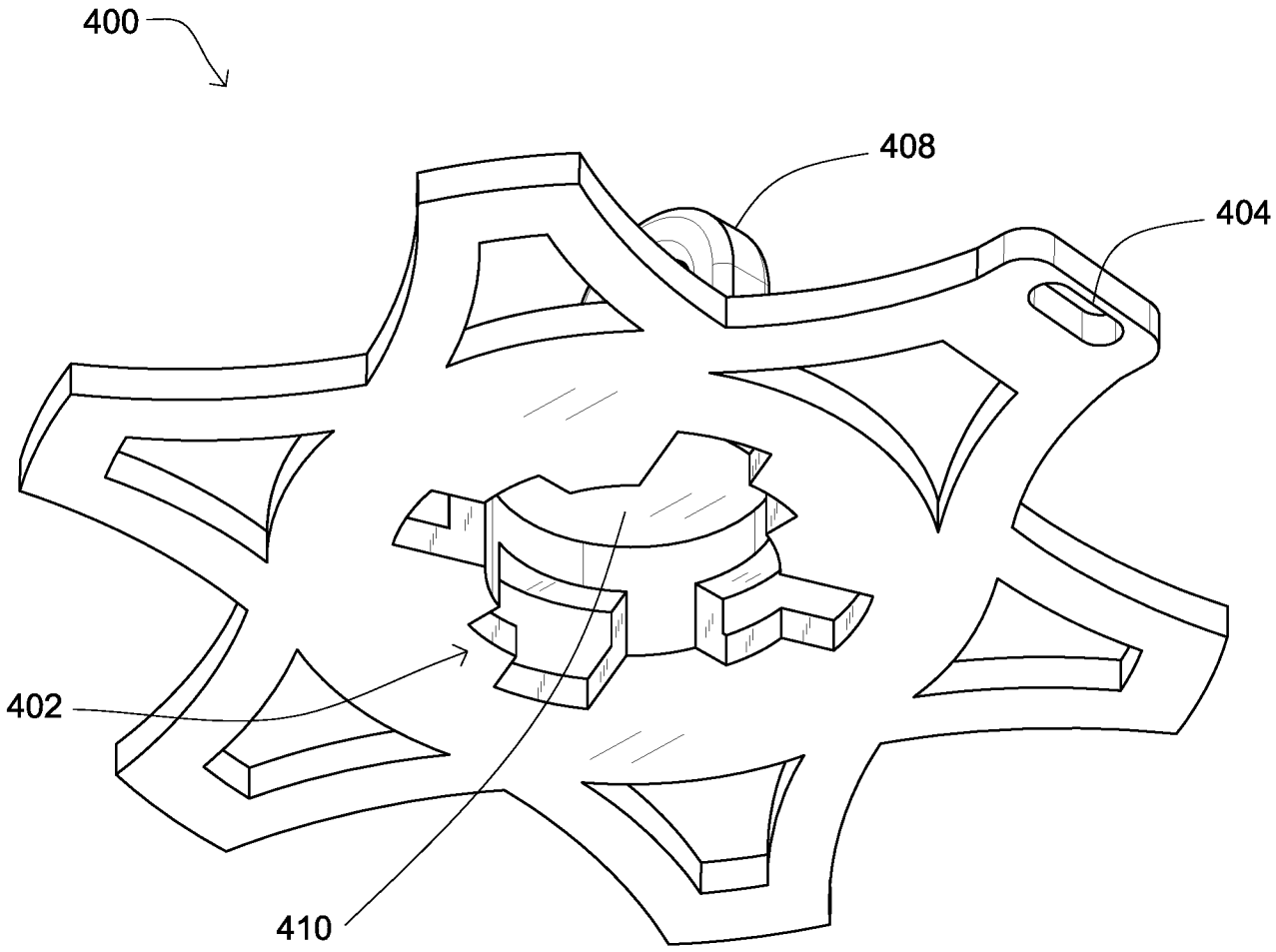
FIG. 6 is a bottom perspective view of a roll cartridge, according to one embodiment of the invention.

FIGS. 5 and 6 are top and bottom perspective views, respectively, of a roll cartridge, according to one embodiment of the invention. The illustrated roll cartridge 400 includes a first twist-lock connector 402, a locking pin receiver 404, a writing utensil slot 406, and a carabiner receiver 408. The roll cartridge 400 may allow a user to end a stack of roll cartridges without having an exposed connector.

The carabiner receiver 408 is affixed to the end opposite the first twist-lock connector 402 so as not to interfere with the connection to another roll cartridge. Such may also/alternatively be in another configuration so long as the first twist-lock connector 402 is able to connect to a second twist-lock connector without issue. The carabiner receiver 408 shown is a solid flange with a hole capable of accepting a carabiner or other connector. It is connected to a protruding portion of a solid cylinder 410 so that it may add strength to the roll cartridge 400 and/or provide a backstop to the associated second twist-lock connector to which the roll cartridge 400 would couple.

This solid cylinder 410 may also assist the first twist-lock connector 402 with added strength as well as may provide the area necessary to lock in a second twist-lock connector. However, other embodiments may be used, such as a strap, hook, or band affixed to the end cap, or other fastener. To prevent the first twist-lock connector 402 from coming loose, the locking pin receiver 404 is positioned to accept a locking pin from an attached roll cartridge.

The illustrated locking pin receiver 404 is an oblong shape and is not a through hole. The shape may be configured so that it may provide a more stable and secure connection between adjacent tape cutting ends. However, other alternate embodiments may be useful, such as circular, rectangular, or other geometric shapes, as well as the locking pin receiver being a through hole, to facilitate accepting different shaped, sized, and/or actuated locking pins. However, the locking pin receiver 404 may be a through hole to facilitate accepting a different locking pin. This may allow for a more stable and secure connection between roll cartridges.

Figure 7:
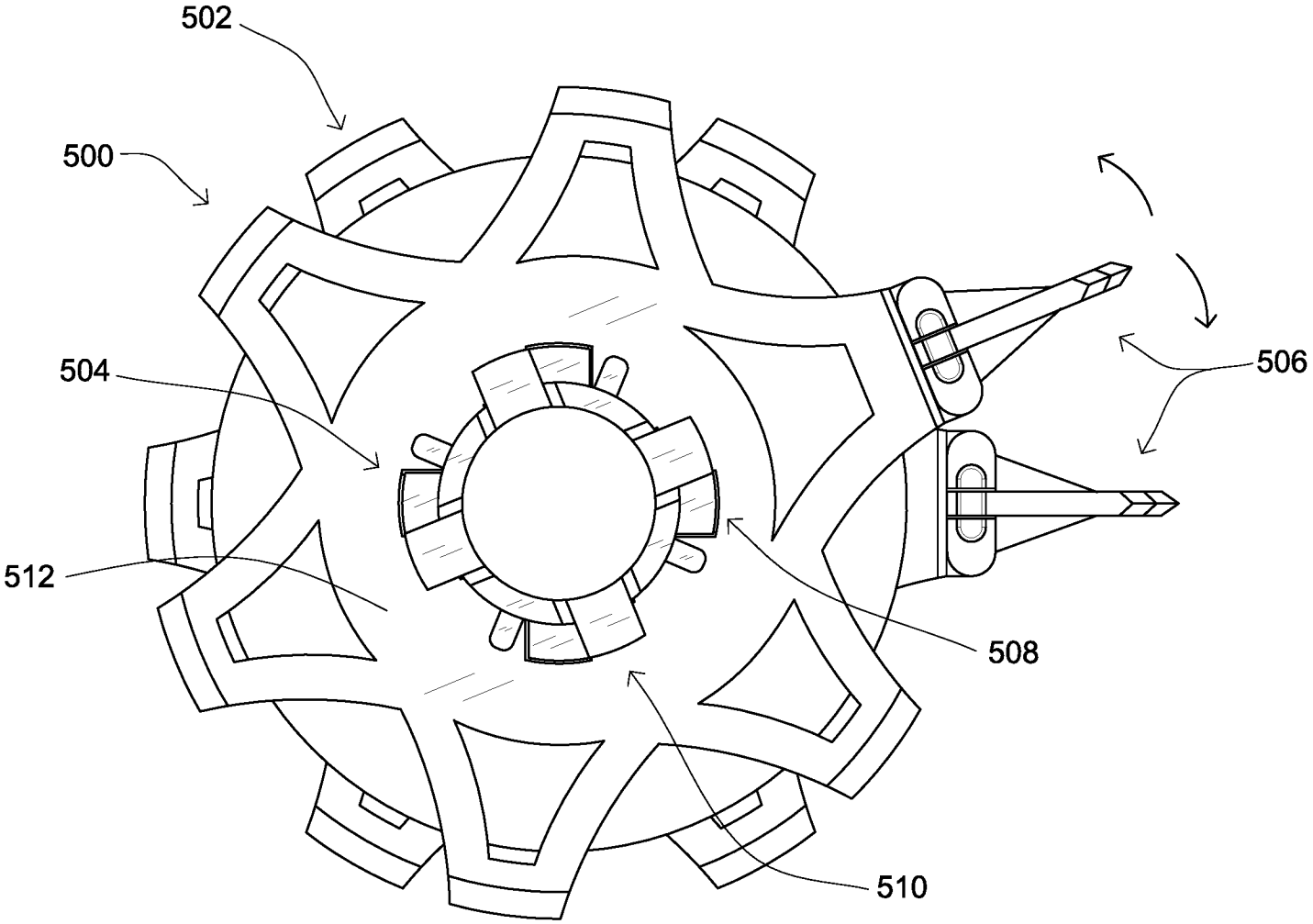
FIG. 7 is a top plan view of a flagging tape dispensing system, according to one embodiment of the invention.

FIG. 7 is a top plan view of a flagging tape dispensing system in process of mating/disengaging, according to one embodiment of the invention. There is shown a first roll cartridge 500 and a second roll cartridge 502 which are partially mated to one another at a roll cartridge mate 504, and each of the roll cartridges, 500 and 502, having tape cutters 506 which are not mated.

Each roll cartridge, 500 and 502, and tape cutters 506 may be configured to interlock with an adjacent roll cartridge and/or tape cutter which may allow one to stack-essentially unlimited cartridges together, with each cartridge connecting to adjacent cartridges and able to disconnect from each other individually at any junction point without having to disconnect other cartridges in the stack.

As illustrated, the roll cartridges, 500 and 502, may be twisted in order to engage and disengage each roll cartridge from one another. To engage two of the illustrated roll cartridges, the user inserts a second twist-lock connector 510 of a roll cartridge into a first twist-lock connector 508 of another roll cartridge and by grasping the base plate 512, twists the roll cartridge clockwise until the second twist-lock 508 connector is snugly within the first twist-lock connector 510 and will no longer turn.

To disengage the illustrated cartridges, they may simply be pulled apart from each other (i.e. out of the page for the one in front, and into the page for the one in back). To disengage fully mated cartridges, the user grasps the base plate 512 and twists counterclockwise until the second twist-lock connector 510 feels loose within the first twist-lock connector 508 and will no longer turn. At that point, the user may pull the loose roll cartridge directly away from the other unit to separate.

Figure 8:
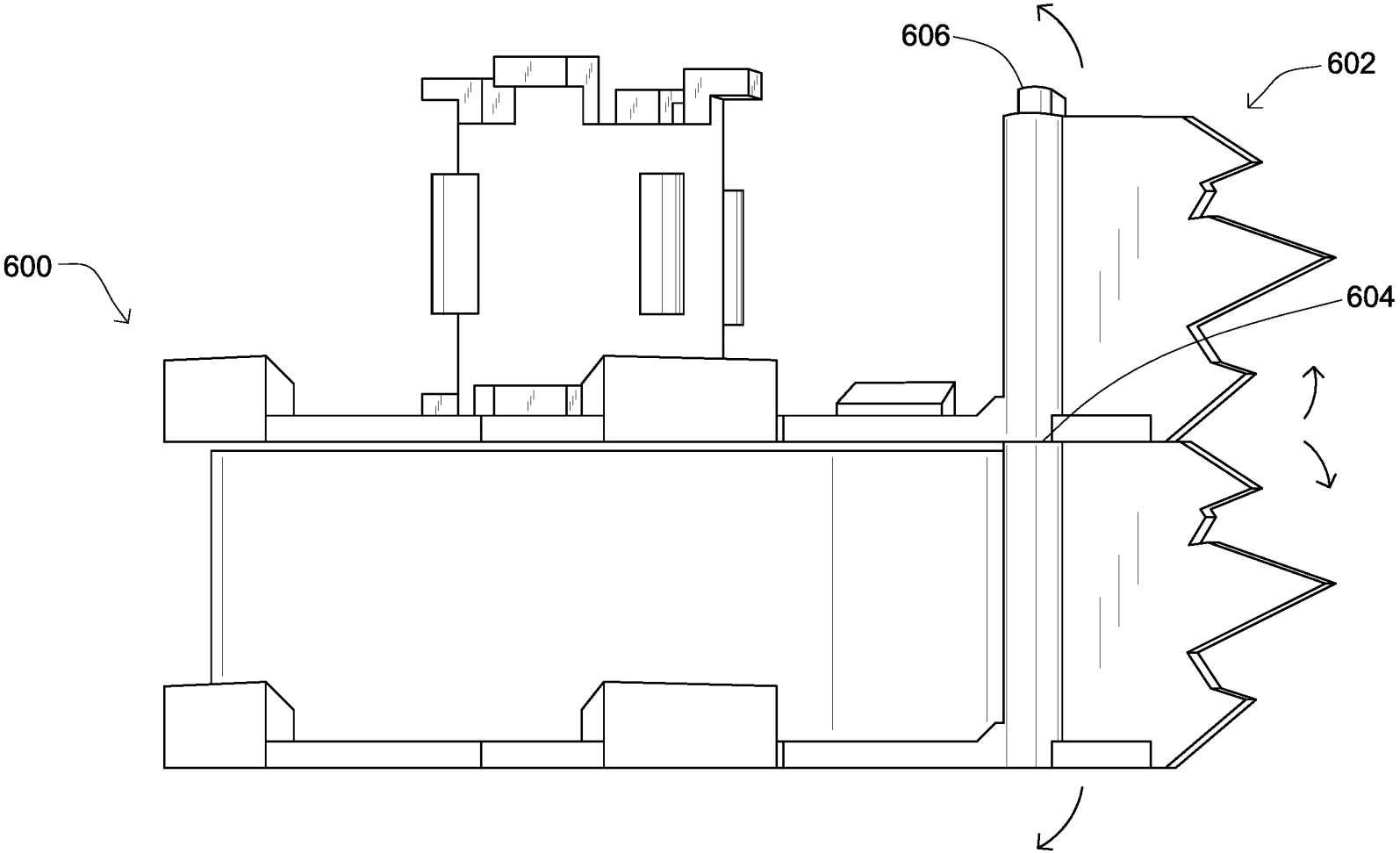
FIG. 8 is a side elevational view of a flagging tape dispensing system, according to one embodiment of the invention.

FIG. 8 is a side elevational view of a roll cartridge, according to one embodiment of the invention. The illustrated roll cartridges 600 include tape cutters 602 which are configured to lock together at the tape cutter mate 604, ensuring that the tape cutters 602 and roll cartridges 600 do not rotate separately once multiple tape cutters 602 and roll cartridges 600 are connected. This also may lend strength and stability from adjacent roll cartridges to a particular roll cartridge in operation. Accordingly, even where a user plans to only use a single type of tape, they may create a stack of three, just to enjoy the added stability.

This locking of adjacent tape cutters 602 benefits the user as the user does not need to worry about other roll cartridges rotating when attempting to pull off and cut a section of flagging tape. Additionally, it helps secure the roll cartridges 600 and cartridge mates 606 so that the flagging tape dispensing, system does not disassemble when in use or when jostled. When positioned at the tape cutter 602, it may also help create a stable arrangement at the tape cutter.

To disengage the tape critter mate 604, the existing flexibility in the structure of the system itself may provide sufficient ability for a user to "force" the locking pin 606 to disengage while still preventing the locking pin 606 from disengaging during normal use. Alternatively, the user may push the locking pin 606 from the side opposite the locking pin 606 or there may be a release mechanism such as a button, lever, or other known release mechanism.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, other embodiments may have an anti-rotation lock built integrated into the first twist lock connector, second twist lock connector, base plate, and/or hub which may snap place or seat inside a recess to prevent the roll cartridges from rotating relative to one another once assembled.

Additionally, a roll cartridge may additionally contain a connector, such as a clamp, hook, band, or other fastener in order to clip the flagging tape dispensing system to a user's body, clothing, or equipment. This connector may be configured to allow the user to wear the flagging tape dispenser as well as to assist in keeping the flagging tape dispenser stable and in one place so one-handed operation by the user is feasible and simple.

It is also envisioned, depending on the user's momentary needs, a flagging tape dispensing system that may include any number of roll cartridges, each with or without a ribbon tensioning system, simply by adding or subtracting roll cartridges to or from the stack.

It is expected that there could be numerous variations of the design of this invention. An example is that there may only be one threading slot which may be directly through the teeth so that the user doesn't need to re-feed tape through another threading slot to cut tape in the opposite direction.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A tape dispensing system, comprising:

a) a first roll cartridge, the first roll cartridge including:
  i) a hub having a first axial side and a second axial side opposite thereto;
  ii) a first twist-lock connector integral with the first axial side of the hub;
  iii) a second twist-lock connector integral with the second axial side of the hub; and
  iv) a tape cutter extending, radially from the hub and including a locking pin and a locking pin receptacle opposite thereto; and b) a second roll cartridge substantially identical to the first roll cartridge, wherein the first twist-lock connector of the second roll cartridge mates with the second twist lock connector of the first roll cartridge.

2. The system of claim 1, wherein the tape cutter includes a threading slot.

3. The system of claim 1, further comprising a star-shaped base plate extending radially away from the hub.

4. The system of claim 1, wherein the first twist-lock connector is an array of male protrusions and the second twist-lock connector is an array of female receptacles shaped to receive the male protrusions.

5. The system of claim 1, further comprising a plurality of roll-centering ridges extending radially from the hub.

6. The system of claim 1, further comprising a third roll cartridge including a twist-lock connector opposite a carabiner mount.

7. The system of claim 6, wherein the third roll cartridge includes a star-shaped baseplate extending radially from the twist-lock connector.

8. The system of claim 7, wherein the star-shaped base plate of the third roll cartridge includes a locking pin receptacle.

9. A tape dispensing system, comprising:

a) a first roll cartridge, the first roll cartridge including:
  i) a hub having a first axial side and a second axial side opposite thereto;
  ii) a first twist-lock connector disposed about the first axial side of the hub;

iii) a second twist-lock connector disposed about the second axial side of the hub; and iv) a tape cutter extending radially from the hub;

b) a second roll cartridge substantially identical to the first roll cartridge, wherein the first twist-lock connector of the second roll cartridge is mated with the second twist lock connector of the first roll cartridge; and c) a third roll cartridge including a twist-lock connector and a carabiner mount opposite thereto, the twist-lock connector mated with the first twist-lock connector of the first roll cartridge and including a star-shaped baseplate extending radially from the twist-lock connector.

10. The system of claim 9, wherein the first and second roll cartridges are selectably couplable.

11. The system of claim 10, wherein the star-shaped base plate of the third roll cartridge includes a locking pin receptacle.

12. The system of claim 11, wherein the tape cutter includes a threading slot.

13. The system of claim 12, wherein the tape cutter includes a locking pin and a locking pin receptacle opposite thereto.

14. The system of claim 13, wherein the first and second roll cartridges include a star-shaped base plate extending radially away from the hub.

15. The system of claim 14, wherein the first twist-lock connector is an array of male protrusions and the second twist-lock connector is an array of female receptacles shaped to receive the male protrusions.

16. The system of claim 15, further comprising a plurality of roll-centering ridges extending radially from the hub.

17. The system of claim 16, wherein the base plate of the third roll cartridge includes a tab protruding from one side of the base plate.

18. The system of claim 17, wherein the base plates of the first and second roll cartridges include a tab protruding from one side of the base plate.

* * * * *